US006102082A

United States Patent [19]

Hehle et al.

[11] Patent Number: 6,102,082

[45] Date of Patent: Aug. 15, 2000

[54] SELVAGE CUTTER FOR CUTTING WEFT ENDS TO A UNIFORM LENGTH IN A WEAVING LOOM

[75] Inventors: Josef Hehle, Hoerbranz, Austria; Hubertus Ludwig, Lindau, Germany

[73] Assignee: Lindauer Dornier Gesellschaft mbH, Germany

[21] Appl. No.: 09/250,830

[22] Filed: Feb. 17, 1999

[30] Foreign Application Priority Data

Feb. 19, 1998 [DE] Germany ..... 198 06 953

[51] Int. Cl.[7] ..... D03D 49/70; D03J 1/08

[52] U.S. Cl. ..... 139/302

[58] Field of Search ..... 139/302

[56] References Cited

U.S. PATENT DOCUMENTS

| | | | |
|---|---|---|---|
| 2,389,809 | 11/1945 | Moessinger . | |
| 4,470,435 | 9/1984 | Lucian et al. . | |
| 4,905,741 | 3/1990 | Wahhoud et al. | 139/302 |
| 5,090,456 | 2/1992 | Kasahara | 139/302 |

FOREIGN PATENT DOCUMENTS

| | | |
|---|---|---|
| 2271320 | 12/1975 | France . |
| 2276411 | 1/1976 | France . |
| 7832131 | 12/1979 | France . |
| 2508942 | 1/1983 | France . |
| 870230 | 3/1953 | Germany . |
| 2042207 | 3/1972 | Germany . |
| 2435397 | 1/1976 | Germany . |
| 3219457C2 | 2/1983 | Germany . |
| 392415 | 9/1965 | Switzerland . |
| 2021161 | 11/1979 | United Kingdom . |

*Primary Examiner*—Andy Falik
*Attorney, Agent, or Firm*—W. F. Fasse; W. G. Fasse

[57] ABSTRACT

A selvage cutter for a weaving loom has a cutter guide (9A, 9B) that causes the cutter to follow the cut fabric edge (8A) dependent on any fabric edge shrinkage locations (SL). The cutter guide has a guide claw (9A) that is elastically urged into contact with the cut fabric edge (8A) by a spring mechanism (14, 14A) which causes the cutting blades (3, 5) to move along a cutting path (8B) that follows the contour of the cut fabric edge (8A), whereby each cut weft thread end (8B) protruding from the cut fabric edge (8A) has the same length and the cutting line conforms to the contour of the cut fabric edge (8A) including shrinkage locations (SL).

15 Claims, 4 Drawing Sheets

SELVAGE CUTTER FOR CUTTING WEFT ENDS TO A UNIFORM LENGTH IN A WEAVING LOOM

PRIORITY CLAIM

This application is based on and claims the priority under 35 U.S.C. §119 of German Patent Application DE 198 06 953.7, filed in Germany on Feb. 19, 1998.

FIELD OF THE INVENTION

The invention relates to a selvage cutter for weaving looms, especially for cutting off a catch selvage from the fabric along a fabric edge which itself may be a leno selvage.

BACKGROUND INFORMATION

German Patent Publication DE 3,219,457 C2 discloses a selvage cutter for a loom for severing the catch selvage from the fabric prior to rolling the fabric up on a fabric take-up roller or fabric beam. The known selvage cutter includes a positively driven scissors cutter guided along a cutting path between the fabric edge or selvage and the catch selvage. The scissors cutter is arranged in a plane extending vertically above the plane of the fabric. In order to assure a reliable guiding of the scissors cutter along a cutting path and to prevent an excursion into the fabric, one end of the known scissors cutter is suspended by a pendulum bearing that permits a limited lateral excursion in the direction of the weft insertion. The other end of the scissors cutter that dips into the cutting path or gap is equipped with guide surfaces that extend in parallel to the cutting edges for an automatic guiding of the scissors cutter in the cutting path or gap. These guide surfaces contact on the one side the fabric selvage, and on the other side the catch selvage. Even though the known scissors cutter is suspended by a pendulum roller bearing, it is not possible to track the known scissors cutter along the fabric selvage or edge in a follower manner. As a result, when for example, due to localized contractions or shrinkage of the fabric along the fabric selvage or edge, the cut weft thread ends are of uneven length because the scissors cutter cannot directly follow the fabric edge or selvage.

German Patent Publication DE 2,042,207 B2 discloses a selvage cutter for fabric edges with a fixed shearing head that is mounted in a fixed position relative to the longitudinal fabric movement toward the fabric take-up. In order to permit the shearing head to rapidly respond to varying or changing margin or edge conditions of the fabric web, the shearing head is positively driven by a cross-position adjustment drive. The drive in turn is controlled by a sensor device that produces an adjustment signal in response to a characteristic of the fabric edge, such as a shrinkage location, whereby the longitudinally stationary head is nevertheless adjustable back and forth in the weft insertion direction. Such an arrangement is quite costly.

German Patent Publication DE PS 870,230 discloses a cutter for a loom, wherein the cutter is mounted on a carrier permitting a displacement of the cutter in the direction of the weft thread insertion. A guide member made of sheet metal which is so positioned that the leno thread pairs (19) and (20) on the one hand and (21) and (22) on the other hand are constantly correcting the position of the sheet metal guide member (35). There is no disclosure how and by what elements it is assured that the sheet metal guide member will always be positively guided along the fabric edge.

French Patent Publication FR PS 2,271,320 discloses a cutter with cutting blades supported on a carrier equipped with guide elements. On the one hand these guide elements contact the fabric edge and on the other hand the guide elements contact the catch selvage downstream of the point of cutting. Such an arrangement also does not assure that the cut edge positively follows the contour of the fabric edge. This is so because the guide element that contacts the fabric edge does so voluntarily, so to speak, and is not positively biased into contact with the fabric edge.

French Patent Publication FR PS 2,426,106 discloses a cutter for a loom, wherein no guide elements are provided in the area of the cutting blades, so that a fabric edge follower motion is not possible.

German Patent Publication DE 2,435,397 A1 shows a cutter device with a tilting body to which a cutting blade carrier is attached. A movable cutting blade is connected to a blade drive for moving the cutting blade about the rotational axis of a blade journal forming part of the cutting device. A fixed cutting blade is also supported by the blade carrier which in turn is journalled on a fixed journal axis that is secured to the loom frame at a spacing from the blade journal so that the cutting device can be tilted about the fixed journal axis in a plane of the fabric which itself is supported by a fabric spreader.

Prior to the begin of any cutting for severing the catch selvage from the fabric edge, it is necessary to align and guide the cutting device relative to a cutting path or gap positioned between the fabric edge and the catch selvage which runs in parallel to the fabric edge being woven. The alignment and guiding takes place with the aid of a track follower wheel (13) secured to the cutting device. The track follower wheel runs ahead of the cutting point for determining the cutting line between the fabric edge and the catch selvage. The cutting device is tiltable about a cutter journal defining a rotational center which is positioned in the cutting plane, but spaced from the central axis of the cutter journal. The track follower wheel makes sure that the cutting device is guided substantially in parallel to the fabric edge. However, the length of the weft threads projecting out of the fabric edge after cutting may have different lengths, for example due to a localized fabric shrinkage or contraction near the fabric edge.

In connection with fabrics which have a relatively large shrinkage characteristic due to the type of material being woven, it is not possible to guide the known cutting device in follower fashion along the direction of the fabric edge. As a result, where there is a localized shrinkage at the fabric edge relatively long weft thread ends project from the fabric edge after the cutting. Additionally, these projecting relatively long weft thread ends may have individually different projecting lengths. Furthermore, in fabrics in which fabric sections with a high weft density alternate with fabric sections having a low weft density, the localized shrinkage characteristic of the fabric edge changes accordingly with these sections of different density so that again the same fabric edge has projecting weft thread ends of varying length. Such projecting weft threads of varying length are undesirable because they cause a problem in any following production processes for ready-made wearing apparel. This problem occurs when the fabric edge of a garment must be formed as a tucked-in seam which has a poor sewability due to the projecting weft ends of different lengths.

The above mentioned German Patent Publication DE 2,435,397 A1 also discloses an embodiment in which the cutting device is positioned or mounted in a plane in which the fabric is supported by a fabric spreader. Such a position limits the tiltability of the cutting device and additionally requires a spring loading. The spring loading is supposed to assure that the track follower wheel which reaches into the weft threads has a certain guide play in the direction of the fabric edge as well as in the direction of the catch selvage. Even in this version of the known cutting device, there is no assurance that the cutter will be positively guided with reference to the fabric edge in a follower fashion.

OBJECTS OF THE INVENTION

In view of the foregoing it is the aim of the invention to achieve the following objects singly or in combination.

- to construct a selvage cutter for a weaving loom so that a true follower motion of a cutter guide member relative to the cut fabric edge is assured or enforced dependent on any irregularities, such as localized shrinkage or shrinkage locations, along the fabric edge;
- to assure that after the cutting the cut weft thread ends protruding from the fabric edge have a uniform length dependent on any fabric edge irregularities whereby a line connecting the free tips of the cut weft thread ends conforms to the contour of the cut fabric edge; and
- to provide a fabric edge follower that is positioned downstream of the cutting point as viewed in the feed advance direction of the fabric for an intended positive and elastic guiding of the cutting blades to move along a cutting path that follows the contour of the cut edge of the fabric in response to fabric edge irregularities along the fabric edge such as shrinkage locations; and
- to make sure that all cut weft thread ends protruding from the fabric edge have the same length, whereby shrinkage locations along the cut edge of the fabric are taken into account.

SUMMARY OF THE INVENTION

A selvage cutter according to the invention is characterized by a scissors cutter including a stationary cutter blade fixed to or part of a cutter carrier, and a movable cutter blade journalled to the cutter carrier or fixed blade which also supports a cutter drive to move the movable cutter blade for severing weft threads between a fabric edge and a catch selvage along a cutting path that follows the contour of the cut fabric edge in response to a cutter guide also secured to the cutter carrier for elastically engaging the cut edge of the fabric downstream of a cutting point as viewed in a feed advance direction of the fabric toward a fabric take up beam. A carrier journal journals the carrier to a fixed support which in turn is secured to the loom frame. The carrier journal preferably extends vertically, thereby permitting the movement of the cutter guide in a plane defined by the fabric travelling horizontally. The biasing of the cutter guide is accomplished by a biasing assembly interposed between the fixed support and the cutter carrier for applying an elastic biasing force to the cutter guide so that the cutting blades move along a cutting path that follows the contour of the cut fabric edge in response to the contour of the cut fabric edge including edge irregularities, such as shrinkage locations along the cut fabric edge whereby each cut weft thread end protruding from the cut fabric edge has the same length.

It is an important advantage of the invention that the protruding cut weft threads all have the same length because this feature improves the quality of the fabric with regard to the production of garments when tuck-in seams must be stitched along garment edges which now can be produced more uniformly.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
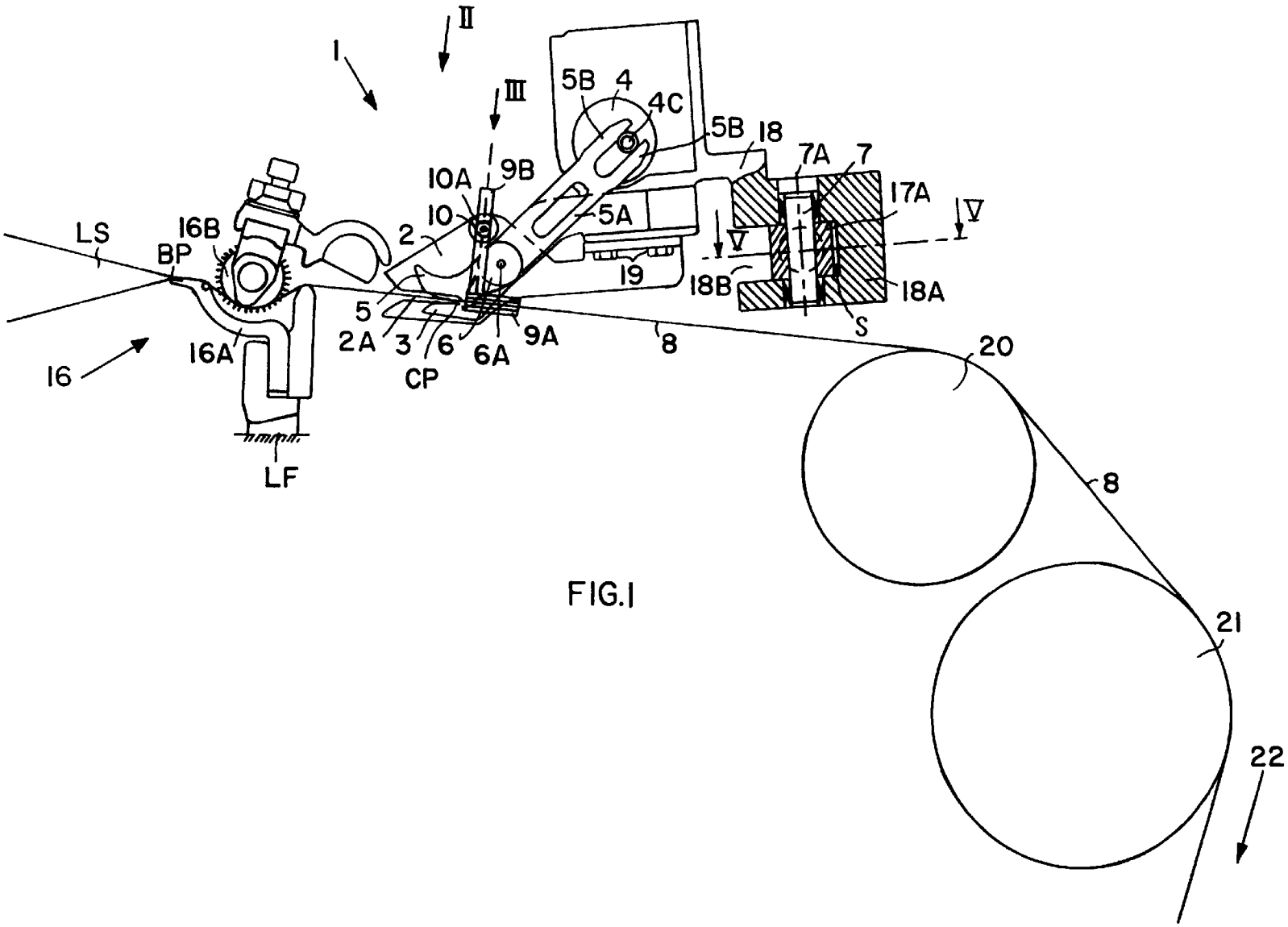
FIG. 1 is a schematic side view of the present selvage cutter, wherein the fabric extends perpendicularly or normal to the plane of the drawing sheet and moves in the fabric feed advance direction from left to right.
Figure 2:
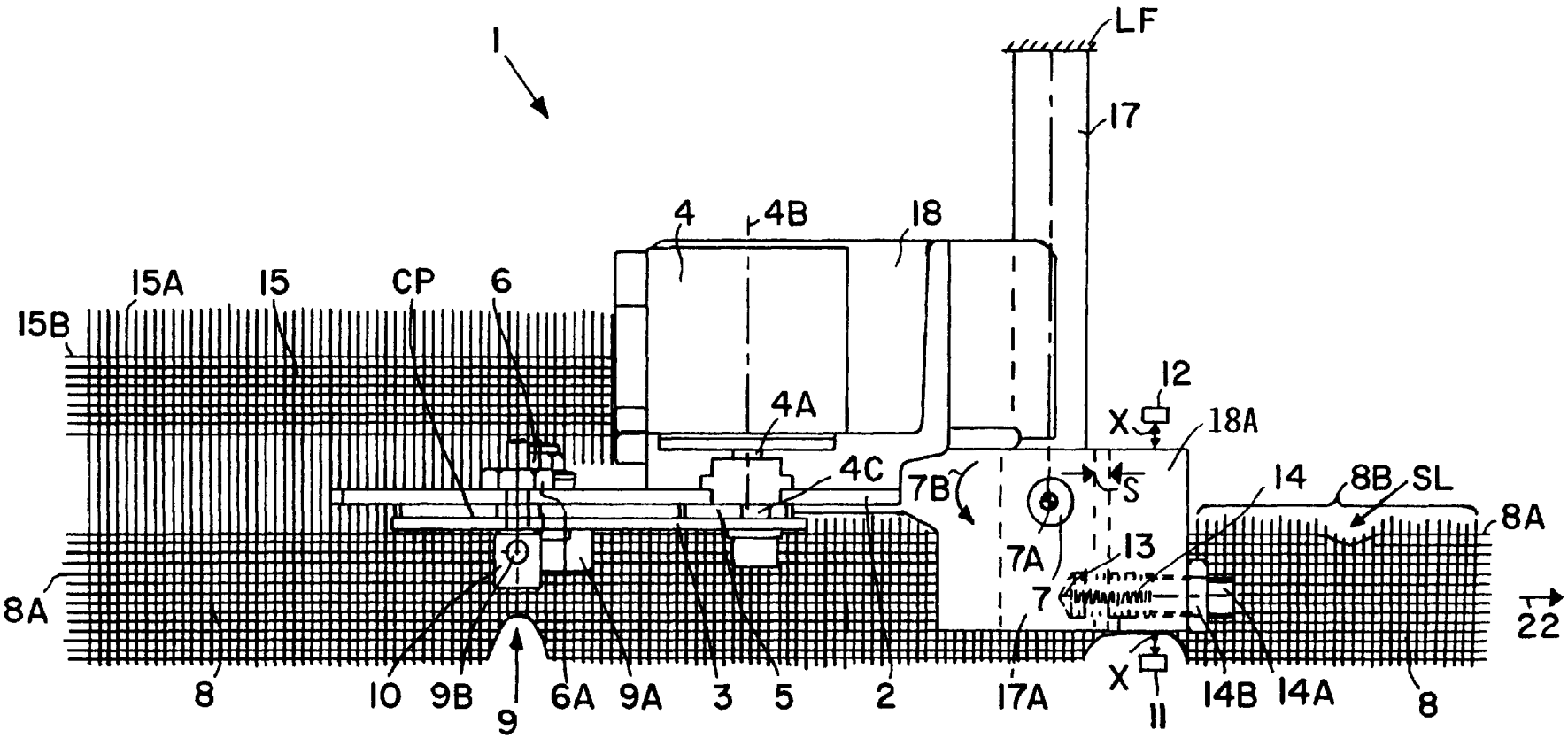
FIG. 2 is a top plan view in the direction of the arrow II in FIG. 1, however omitting a fabric spreader and fabric guide rollers shown in FIG. 1.

FIGS. 1 and 2 viewed in conjunction show a fixed cutter support 17 that is rigidly secured to a loom frame LF merely symbolically shown. FIG. 1 shows a fabric spreader 16 positioned downstream of a beat-up point BP and of the loom shed LS. Fabric guide rollers 20 and 21 are positioned downstream of the fabric spreader 16 as viewed in the feed advance or take-up direction 22 of the fabric 8. The fabric spreader 16 includes a fabric support 16A and a needle or rod spreader 16B. The spreader is merely shown to illustrate the position of a selvage cutter 1 downstream of the spreader and upstream of the guide roller 20 as viewed in the feed advance direction 22. A fabric take-up roller positioned downstream of the guide roller 21 is not shown.

Referring to FIG. 2 the fabric 8 is woven with two selvages 8A and 15. To differentiate between the two, the selvage 8A which may, for example be a leno selvage, will be referred to as cut fabric edge 8A and the selvage 15 will be referred to as catch selvage 15 because it initially holds or catches the weft threads 15A woven with selvage warp threads 15B to prevent the weft ends from drawing back into the fabric 8 as soon as the weft insertion force is removed.

The fabric 8 and the catch selvage 15 are interconnected with each other by the weft threads 15A upstream of a cutting point CP. Downstream of the cutting point CP the catch selvage 15 is severed from the fabric by the cutting of the weft threads 15A, whereby the cut weft ends 8B protruding from the fabric edge 8A are cut to a uniform length all along including shrinkage locations LS in the cut fabric edge 8A, as will be explained in more detail below.

The cutting is accomplished by a weft selvage cutter 1 which severs the fabric 8 from the catch selvage 15. In order to achieve the intended and beneficial uniform length of the protruding weft ends 8B dependent on any localized shrinkage locations SL or other irregularities in the cut fabric edge 8A, the selvage cutter 1 according to the invention is equipped with a cutter guide 9 that is biased by a compression spring 14 for continuously and elastically urging a guide claw 9A into engagement with the fabric edge 8A downstream of the cutting point CP. The guide element 9A is adjustable in its position relative to the fabric edge 8A, whereby the cutter blades 3 and 5 and the entire selvage cutter 1 are guided in a follower manner along the fabric edge 8A. This guiding in response to the biasing force has the advantage that neither a high weft density nor a low weft density in the fabric can adversely influence the cutting of weft ends 8B of uniform length all along the cut fabric edge because the guide claw 9A functions as a follower that senses irregularities along the fabric edge 8A.

The selvage cutter 1 has a cutter carrier 18 with a claw-shaped extension 18A having an opening 18B. A flat, for example sheet metal cutter carrier extension 2 is secured by screws 19 to a downwardly facing side of the carrier 18. A journal pin 7 secures the cutter carrier 18 through its claw 18A to the fixed support 17. The support 17 has a free support end 17A preferably with a square or rectangular cross-section reaching into the claw opening 18B with a spacing S between the support end 17A and the opening facing wall of the claw 18A. The spacing S is of sufficient width to permit the tilting motion of the carrier 18, 18A and thus of the cutter guide 9 for the required follower motion along the cut fabric edge 8A. This tilting motion takes place in the plane defined by the fabric 8 in the drawing plane of FIG. 2 as indicated by the arrow 7B. The tilting motion is stopped when one corner or the other corner of the claw 18A facing the support end 17A contacts the support end. The spacing S is so selected that a proper guiding along the fabric edge 8A is assured even if shrinkage locations SL along the cut fabric edge 8A. The cutter carrier 18 supports a cutter drive 4 such as an electric motor positioned with a spacing from the rotational axis or journal axis 7A of the journal pin 7. The drive 4 has a drive shaft 4A rotatable about a rotational axis 4B. As mentioned, the cutter carrier 18, is tiltable about the journal axis 7A of the journal pin 7, as indicated by the arrow 7B in FIGS. 2 and 5 in response to the torque moment exerted by the spring force SF times the distance d, shown in FIG. 5, as will be described in more detail below.

Referring to FIG. 1, the carrier 18 with its extension 2 carries the fixed cutter blade 3 and the movable cutter blade 5 journaled to the carrier 2 by the blade journal 6 having a rotational axis 6A. The movable cutter blade 5 has an extension 5A provided with forked ends 5B engaged by a crank drive 4C driven by a shaft 4A of the cutter drive motor 4. Since the movable cutter blade 5 is journalled by the journal 6, the cutter blade 5 is tiltable about the journal axis 6A as the crank drive 4C rotates.

Figure 3:
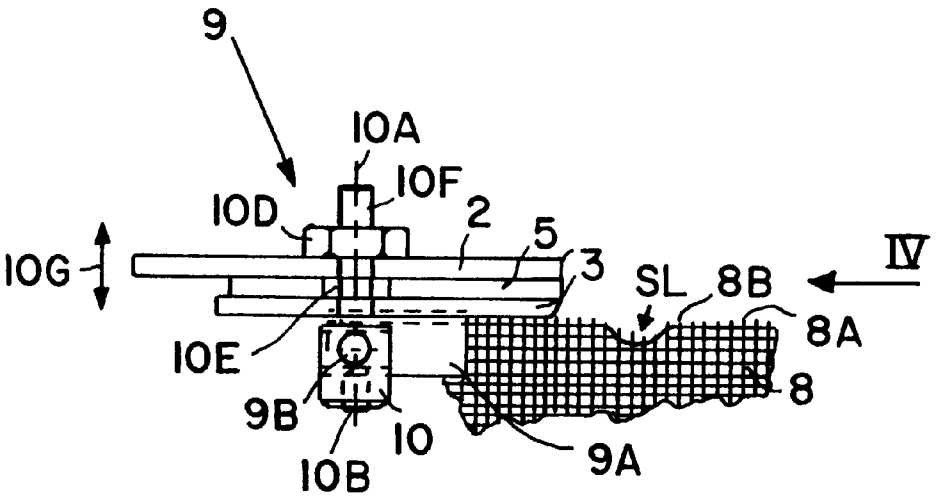
FIG. 3 is a detail view in the direction of the arrow III in FIG. 1, illustrating a top plan view of the cutter guide elements and their position adjustable mounting.
Figure 4:
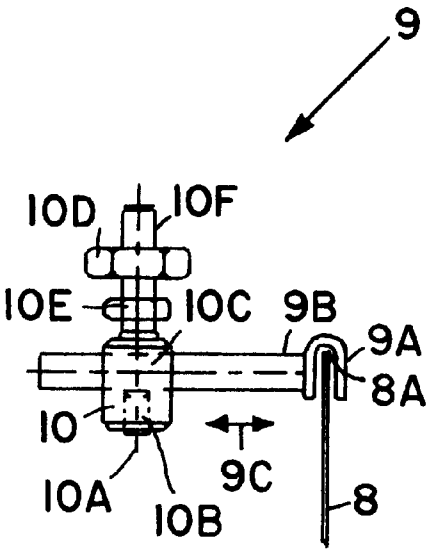
FIG. 4 is a view in the direction of the arrow IV in FIG. 3 to illustrate the engagement of one of the guide elements in the form of a guide claw with the fabric edge.

Referring to FIGS. 3 and 4, the guide 9 is mounted to the carrier extension 2 by a guide mounting 10 in such a position that the guide claw 9A carried by a guide pin 9B is engaging the cut fabric edge 8A of the fabric 8 as best seen in FIG. 4. The guide claw 9A reaches around the cut fabric edge 8A. The guide pin 9B carrying the fabric edge follower claw 9A at one end is secured at its other end in the guide mounting 10 having a longitudinal axis 10A extending perpendicularly to the vertically extending carrier extension 2. The guide pin 9B is adjustable back and forth in the guide mounting 10 in the direction of the arrow 9C when a clamping screw 10B, such as a set screw, is loosened. Once the guide pin 9B has been adjusted in the required position relative to the plane defined by the fabric 8, the set screw 10B is tightened again.

Further, the guide mounting 10 has an extension 10F that fits through a hole in the carrier extension 2, whereby the guide mounting 10 with its extension can be adjusted back and forth in the direction of the arrow 10G when the nuts 10D and 10E are loosened. Once the proper position is established for the guide mounting 10, both nuts 10D and 10E are tightened again.

Figure 5:
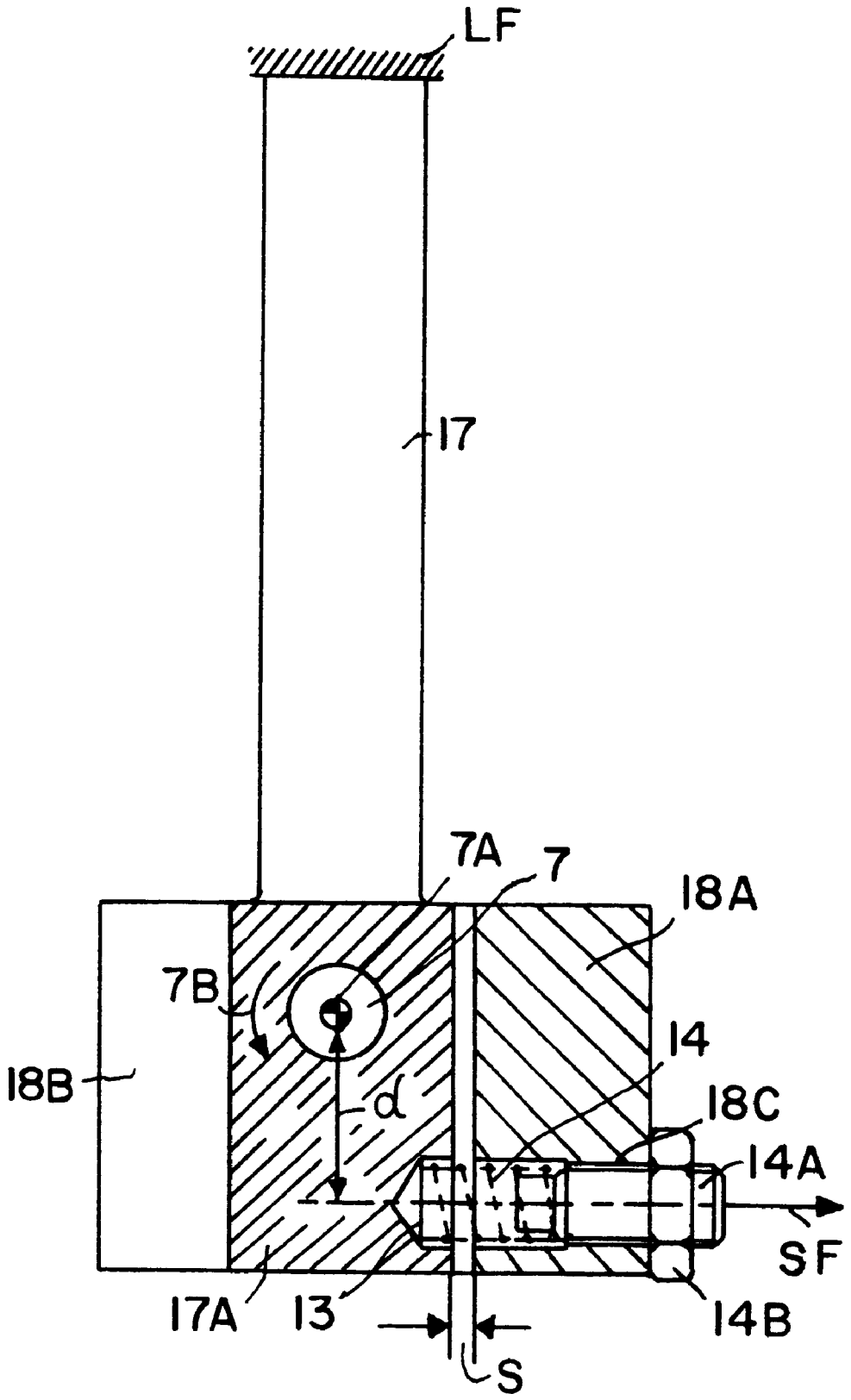
FIG. 5 is a sectional view along section line V—V in FIG. 1, on a slightly enlarged scale compared to FIG. 1 to show details of a biasing assembly which urges the guide claw into a follower contact with a cut fabric edge.

Referring further to FIG. 5, the cutter carrier 18 with its claw-shaped carrier extension 18A forms the opening 18B to receive the free end 17A of the fixed support 17. The opposite end of the support 17 is connected rigidly to the loom frame LF as mentioned. The journal pin 7 also shown in FIG. 1 and in FIG. 2 is so positioned that the spacing S is provided between the inwardly facing wall of the claw and the side wall of the support end 17A to permit the tilting and respective follower motion. As best seen in FIG. 1 the journal pin 7 reaches into opposite aligned openings of the carrier claw 18A. For the assembly, the claw section 18A may be divided into two portions, for example, along the section plane V—V and the two portions can then be interconnected by a screw not shown. However, it is also possible to align a hole in the free support end 17A with both aligned openings in the carrier claw and to then insert the journal pin 7 with an interference fit in the hole of the support end while providing a slide fit between the pin ends and the aligned openings in the claw 18A.

In order to exert the torque moment as indicated by the tilting arrow 7B, the biasing assembly shown in FIG. 5 uses a compression spring 14, one end of which rests in a socket 13 in the fixed support end 17A. The other end of the spring 14 is movably held in a bore 18B of the claw section 18A. Preferably, the outer end of bore 18B has a threading for engagement by an adjustment screw 14A, the inner end of which is surrounded by the compression spring 14. A nut 14B is tightened when the adjustment screw 14A has been turned into the proper position, whereby the compression spring 14 exerts a spring force SF as indicated by the respective arrow. The screw 14 can, for example, be turned by inserting a screwdriver into a slot in the outwardly facing end of the screw 14A. The torque moment in the direction of the arrow 7B is then determined by the spacing d between the journal axis 7A and the central axis of the screw 14A. This torque moment makes sure that the guide claw 9A is elastically urged against the fabric edge 8A in the plane defined by the fabric 8 as shown in FIG. 2. Although a compression spring 14 is preferred, the arrangement could be such that a tension spring can be used for the same purpose.

Referring further to FIG. 2, two stop elements 11 and 12 are secured to the loom frame in positions spaced by the spacing X from the respective facing side wall carrier claw 18A. This spacing X corresponds to the expected maximum depth in the weft direction of a shrinkage location SL shown in FIGS. 2 and 3 along the cut fabric edge 8A. The position of the stop members 11 and 12 may be adjustable in the direction of the weft threads 15A by adjustment elements now shown.

Due to the action of the biasing assembly 14, the fabric edge follower claw 9A will follow any setbacks or shrinkage or irregularities SL that may occur along the fabric edge so that the protruding ends 8B of the weft threads 15A will always have the same length. In other words, the guide follower claw 9A will follow such irregularities and a line connecting the outward ends of all cut weft thread ends 8B will also follow a line that conforms to the contour of the cut fabric edge 8A. Thus, such connecting line will normally not be a straight line, which assures that all cut weft ends 8B have the same length all along the fabric edge. Correspondingly, longer cut weft ends at locations of edge irregularities SL have been eliminated by the cutter of the invention.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A selvage cutter (1) for a loom, said selvage cutter comprising a cutter carrier (2, 18), a scissors cutter including a stationary cutter blade (3) fixed to said cutter carrier and a movable cutter blade (5), a blade journal (6, 6A) journalling said movable cutter blade (5) to said cutter carrier, a cutter drive (4, 4C) mounted on said cutter carrier (2, 18), a drive connection (5A, 5B) for transmitting a cutter force from said cutter drive to said movable cutter blade (5), a cutter guide (9, 9A, 9B) secured to said cutter carrier for engaging a cut fabric edge (8A) of a fabric (8) downstream of a cutting point (CP) as viewed in a feed advance direction (22) of said fabric (8), a carrier journal (7) journalling said cutter carrier (2, 18) to a fixed support (17) for permitting a follower movement of said cutter guide in a plane defined by said cut fabric edge (8A) and by said fabric (8), and a spring biasing assembly (14, 14A) interposed between said fixed support (17) and said cutter carrier (2, 18) for applying a biasing force to said cutter guide to urge said cutter guide into contact with said cut fabric edge (8A) in said plane for enforcing said follower movement for cutting all weft ends (8B) to a uniform length in response to shrinkage locations (SL) along said cut fabric edge (8A).

2. The selvage cutter of claim 1, wherein said cutter carrier comprises a mounting section (18, 18A) journalled by said carrier journal (7) to said fixed support (17) and a carrier extension (2) secured to said mounting section (18, 18A), and wherein said movable cutter blade (5) is journalled to said carrier extension (2) by said blade journal (6, 6A).

3. The selvage cutter of claim 2, wherein said stationary cutter blade (3) is an integral part of said carrier extension (2), whereby said movable cutter blade (5) is journalled to said stationary cutter blade (3) by said blade journal (6, 6A).

4. The selvage cutter of claim 1, wherein said cutter guide (9, 9A, 9B) comprises a guide pin (9B) and a guide claw (9A) at one end of said guide pin for engaging said cut fabric edge (8A) downstream of said cutting point (CP), and a guide mounting (10) securing said guide pin (9B) with its other end to said cutter carrier (2).

5. The selvage cutter of claim 4, wherein said guide pin mounting (10) holds said other end of said guide pin (9B) for adjustment, and wherein said guide pin mounting (10) is secured to said cutter carrier (2).

6. The selvage cutter of claim 5, wherein said guide pin mounting (10) has a longitudinal axis (10A) extending normal to said cutter carrier (2) in a position locating said guide claw (9A) downstream of said cutting point (CP) for contacting said cut fabric edge (8A) during said follower movement.

7. The selvage cutter of claim 6, wherein said guide pin mounting (10) has a guide hole wherein said other end of said guide pin (9B) is slidably received for adjusting the position of said guide profile (9A) relative to said cut fabric edge (8A), said guide pin mounting (10) further comprising a locking member (10B) for locking said guide pin (9B) in an adjusted position in said guide pin mounting (10).

8. The selvage cutter of claim 5, wherein said guide pin mounting (10) comprises an extension (10F), said cutter carrier (2) having an opening through which said extension (10F) adjustably fits, and at least one locking element (10D, 10E) for locking said guide pin mounting (10) in an adjusted position relative to said cutter carrier (2).

9. The selvage cutter of claim 1, further comprising a first stop element (11) and a second stop element (12) adapted for connection in fixed locations to said loom opposite carrier side walls of said cutter carrier (18, 18A) for limiting said follower movement of said cutter carrier about said carrier journal (7, 7A).

10. The selvage cutter of claim 9, wherein said first stop element (11) is positioned on a fabric facing side of said selvage cutter with a spacing (X) from its respective cutter carrier side wall, wherein said second stop element (12) is positioned on a cutter carrier side facing away from said fabric also with said spacing (X) from its respective cutter carrier side wall, and wherein said spacing (X) corresponds to a maximum edge shrinkage in the weft direction at a shrinkage location (SL) along said cut fabric edge (8A).

11. The selvage cutter of claim 1, wherein said biasing assembly comprises a biasing spring (14) interposed between said fixed support (17) and said cutter carrier (18) for applying a biasing force (SF) to said cutter carrier and to said cutter guide (9, 9A, 9B) for flexibly urging said cutter guide into contact with said cut fabric edge (8A) in said plane defined by said fabric (8).

12. The selvage cutter of claim 11, wherein said biasing assembly further comprises adjustment elements (14A, 14B) for adjusting said biasing force (SF).

13. The selvage cutter of claim 11, wherein said biasing spring (14) is a compression spring.

14. The selvage cutter of claim 12, wherein said cutter carrier (2, 18) comprises a carrier mounting claw (18A) with an open side (18B) for enclosing said fixed support (17) at least on two sides, and wherein said carrier journal (7) extends through said carrier mounting claw (18A) and through said fixed support (17) in such a position that a spacing (S) is provided between said claw (18A) and said fixed support (17) for permitting said follower movement of said claw (18A) relative to said fixed support (17).

15. The selvage cutter of claim 1, wherein said cutter carrier (2, 18) comprises a carrier extension (2) as a flat vertically extending member having a slot (2A) opening in a direction opposite to said feed advance direction (22) for guiding weft threads (15A) to said cutting point (CP).

* * * * *

UNITED STATES PATENT AND TRADEMARK OFFICE

CERTIFICATE OF CORRECTION

PATENT NO. : 6,102,082
DATED : August 15, 2000
INVENTOR(S) : Hehle et al.

It is certified that error appears in the above-identified patent and that said Letters Patent is hereby corrected as shown below:

Title Page:

Under item [73], Assignee:
Line 2, before "Germany", insert -- Lindau --.

Under item [56] References Cited,
U.S. PATENT DOCUMENTS:
Line 2, after "4,470,435, replace "9/1984" by -- 11/1984 --.

Signed and Sealed this

Seventh Day of August, 2001

*Attest:*

Nicholas P. Godici

*Attesting Officer*

NICHOLAS P. GODICI
*Acting Director of the United States Patent and Trademark Office*